US007658141B2

(12) United States Patent
Masek et al.

(10) Patent No.: US 7,658,141 B2
(45) **Date of Patent: *Feb. 9, 2010**

(54) CLOSED CARTRIDGE FOR PREPARING A BEVERAGE FOR EXTRACTION UNDER PRESSURE

(75) Inventors: Petr Masek, Granges (CH); Alain Riesterer, Vevey (CH)

(73) Assignee: Nestec S.A., Vevey (CH)

( * ) Notice: Subject to any disclaimer, the term of this patent is extended or adjusted under 35 U.S.C. 154(b) by 515 days.

This patent is subject to a terminal disclaimer.

(21) Appl. No.: 11/559,206

(22) Filed: Nov. 13, 2006

(65) Prior Publication Data

US 2007/0068395 A1 Mar. 29, 2007

Related U.S. Application Data

(63) Continuation of application No. 10/396,557, filed on Mar. 26, 2003, now Pat. No. 7,153,530, which is a continuation of application No. PCT/EP01/10344, filed on Sep. 6, 2001.

(30) Foreign Application Priority Data

Sep. 26, 2000 (EP) ..... 00120936

(51) Int. Cl.
*A47J 31/06* (2006.01)

(52) U.S. Cl. ..... 99/295; 426/77; 426/79; 426/82; 426/112; 426/115; 220/495.03; 99/279; 99/323; 99/302 R

(58) Field of Classification Search ..... 426/115, 426/77; 604/411–416; 99/295, 297
See application file for complete search history.

(56) References Cited

U.S. PATENT DOCUMENTS 2,899,886 A 8/1959 Rodth
3,843,806 A 10/1974 Kishpaugh (Continued)

FOREIGN PATENT DOCUMENTS

EP 0 512 468 11/1992
WO WO 00/56629 * 9/2000

OTHER PUBLICATIONS

U.S. Appl. No. 10/328,774, filed Dec. 24, 2002.

*Primary Examiner*—Tu B Hoang
*Assistant Examiner*—Brett Spurlock
(74) *Attorney, Agent, or Firm*—K&L Gates LLP

(57) ABSTRACT

The present invention relates to a closed cartridge (10), for extraction under pressure, comprising a dish (12) with a bottom (13) with a central part and a peripheral part and a side wall having substantially the shape of a frustum of a cone and a circular edge with a diameter greater at the bottom and a cover (15) welded to the periphery of the edge of the dish and the cover is intended to be torn only through the effect of the force of the extraction fluid when extraction starts, the said cartridge comprising, in the dish at the level of the bottom, a means (16) guaranteeing retention of the solid substance when it is opened, in which the means guaranteeing retention of solid substance is a sheet of fabric sealed in the bottom of the dish in two zones, on the one hand in the central part (17) and on the other hand in the peripheral part (18) of the said bottom (13).

17 Claims, 2 Drawing Sheets

U.S. PATENT DOCUMENTS

| | | | | |
|---|---|---|---|---|
| 4,077,876 | A | 3/1978 | Southall | |
| 4,136,202 | A | 1/1979 | Favre | |
| 4,857,053 | A | 8/1989 | Dalton | |
| 4,919,955 | A * | 4/1990 | Mitchell | 426/394 |
| 5,656,316 | A * | 8/1997 | Fond et al. | 426/433 |
| 5,897,899 | A | 4/1999 | Fond | |
| 6,361,744 | B1 * | 3/2002 | Levy | 422/99 |
| 6,849,285 | B2 * | 2/2005 | Masek et al. | 426/112 |
| 6,880,454 | B2 * | 4/2005 | Kollep | 99/295 |
| 2002/0015768 | A1 | 2/2002 | Masek et al. | |

* cited by examiner

CLOSED CARTRIDGE FOR PREPARING A BEVERAGE FOR EXTRACTION UNDER PRESSURE

The present application is a continuation of U.S. patent application Ser No. 10/396,557, filed Mar. 26, 2003, now U.S. Pat. No. 7,153,530 B2, which is a continuation of the U.S. national stage designation of International Application PCT/EP01/10344, filed Sep. 6, 2001, the content of which is expressly incorporated herein by reference thereto.

FIELD OF THE INVENTION

The present invention relates to a sealed cartridge, for extraction under pressure. The cartridge can contain a substance for the preparation of a beverage chosen from ground roasted coffee, tea, instant coffee, a mixture of ground coffee and of instant coffee, a chocolate based product or any other dehydrated edible substance, comprising a dish with a bottom with a central part and a peripheral part and a side wall, having substantially the shape of a frustum of a cone, and a circular edge with a diameter greater at the bottom, and a cover welded to the periphery of the edge of the dish, and the cover is intended to be torn solely upon the effect of the force of the extraction fluid when extraction starts, the said cartridge comprising, in the dish at the level of the bottom, a means guaranteeing retention of the solid substance when it is opened.

BACKGROUND OF THE INVENTION

U.S. patent application Ser. No. 10/328,774, now U.S. Pat. No. 6,880,454, relates to a capsule cage or cartridge, capable of being mounted in a coffee machine, comprising a first part with a channel for the supply of water and a second part forming a housing for the capsule for extraction, in which a perforation system independent of the water-supply channel is provided directly at the exit from the said channel. The cartridge with the means for retention of solid substance, as mentioned above, is insufficient to guarantee complete cleanliness when changing cartridges.

SUMMARY OF THE INVENTION

The present invention can perfect a cartridge provided for the extraction cage as mentioned above and which does not lead to leaks of grounds or of any other solid substance when the said cartridge is changed.

The present invention relates to a closed cartridge in which the means guaranteeing retention of solid substance is a sheet of fabric sealed in the bottom of the dish over two areas, on the one hand in the central part and, on the other hand in the peripheral part of the said bottom. Sealing over the peripheral part of the bottom may be effected over the periphery as a whole or only over a portion of the said periphery. It involves arranging, in each cartridge, a non-return system for the coffee grounds or for any other solid substance extracted in the said cartridge. This system can suit the construction of the extraction head according to U.S. patent application Ser. No. 10/328,774 above.

The fabric used according to the invention has, on the one hand, an acceptable cost and, on the other hand, is simple to produce, allowing easy opening of the capsule by the injection points, being satisfactorily resistant to hot water and providing satisfactory closure after extraction, i.e. when the cartridge is removed.

The fabric used may be any type of fabric, woven or non-woven, made from plastic fibers, from vegetable fibers or from animal fibers. The fabric used is preferably fabric made from polypropylene, polyester, polyurethane, polyamide or cellulose having a thickness of between 15 and 200 microns. The fabric was hot-sealed in the aforesaid two zones in the bottom of the dish.

The cover is heat-welded or crimped to the periphery of the dish. A cartridge which can withstand the pressures which may range up to 15 bar in the extraction system is thereby obtained.

The cartridge is filled with a substance for the preparation of a beverage, as mentioned above. This substance is preferably ground roasted coffee. "Dish" is understood to include a frustoconical, hemispherical or frustopyramidal element. Naturally, the bottom of the dish does not have to be flat.

The principal body of the cartridge that is shown in FIG. 1, namely the dish, of frustoconical shape and of semi-rigid nature, may consist of a material chosen from aluminum having a thickness of 20 to 100 μm, a pure or multi-layer plastic, a cardboard/aluminum/plastic composite and a cardboard/plastic composite.

The cover of the cartridge, of flexible nature, may be made from a material chosen from aluminum with a thickness of 15 to 60 μm and a multi-layer material comprising either paper of 20 to 60 g/m$^2$, plastic of a thickness of 20 to 60 μm and aluminum with a thickness of 5 to 20 μm, or EVOH or PVDC of a thickness of 5 to 30 μm and plastic (PP, PE or PA) of 20 to 100 μm, or PET (5 to 30 μm) and plastic (PP, PE) of 20 to 100 μm, or PET that is metallized or equipped with a layer which forms an efficient barrier, such as $SiO_2$.

The size of the cartridge according to the invention may vary according to the volume of coffee it is desired to prepare. The measure of coffee may vary between 5 and 20 g, the diameter of the cartridge shown is between 2.5 and 6 cm and the thickness of the bed of coffee between 10 and 40 mm.

An embodiment of the invention is a sealed cartridge, for extraction under pressure, containing a substance for the preparation of a beverage chosen from ground roasted coffee, tea, instant coffee, a mixture of ground coffee and of instant coffee, a chocolate based product or any other dehydrated edible substance, comprising a dish with a bottom with a central part and a peripheral part and a side wall, having substantially the shape of a frustum of a cone, and a circular edge with a diameter greater at the bottom, and a cover welded to the periphery of the edge of the dish, and the cover is intended to be torn only through the effect of the force of the extraction fluid when extraction starts, the said cartridge comprising, in the dish at the level of the bottom, a means guaranteeing retention of the solid substance when it is opened, characterized in that the means guaranteeing retention of solid substance is a sheet of fabric sealed in the bottom of the dish over two areas, on the one hand in the central part and, on the other hand in the peripheral part of the said bottom. The cover is welded or crimped to the edge of the dish. The dish is made from a material chosen from aluminum having a thickness of 20 to 100 μm, a pure or multi-layer plastic, a cardboard/aluminum/plastic composite and a cardboard/plastic composite. The cover is made from a material chosen from aluminum with a thickness of 15 to 60 μm and a multi-layer material comprising either paper of 20 to 60 g/m$^2$, plastic of a thickness of 20 to 60 μm and aluminum with a thickness of 5 to 20 μm, or EVOH or PVDC of a thickness of 5 to 30 μm and plastic (PP, PE or PA) of 20 to 100 μm, or PET (5 to 30 μm) and plastic (PP, PE) of 20 to 100 μm, or PET that is metallized or equipped with a layer which forms an efficient barrier, such as $SiO_2$. This cartridge has a diameter of between 2.5 and 6 cm and a height of between 10 and 40 mm. The fabric has a thickness of between 15 and 200 microns.

BRIEF DESCRIPTION OF THE DRAWINGS

The remainder of the description is given with reference to the drawings, in which.

DETAILED DESCRIPTION OF THE PREFERRED EMBODIMENTS

Figure 1:
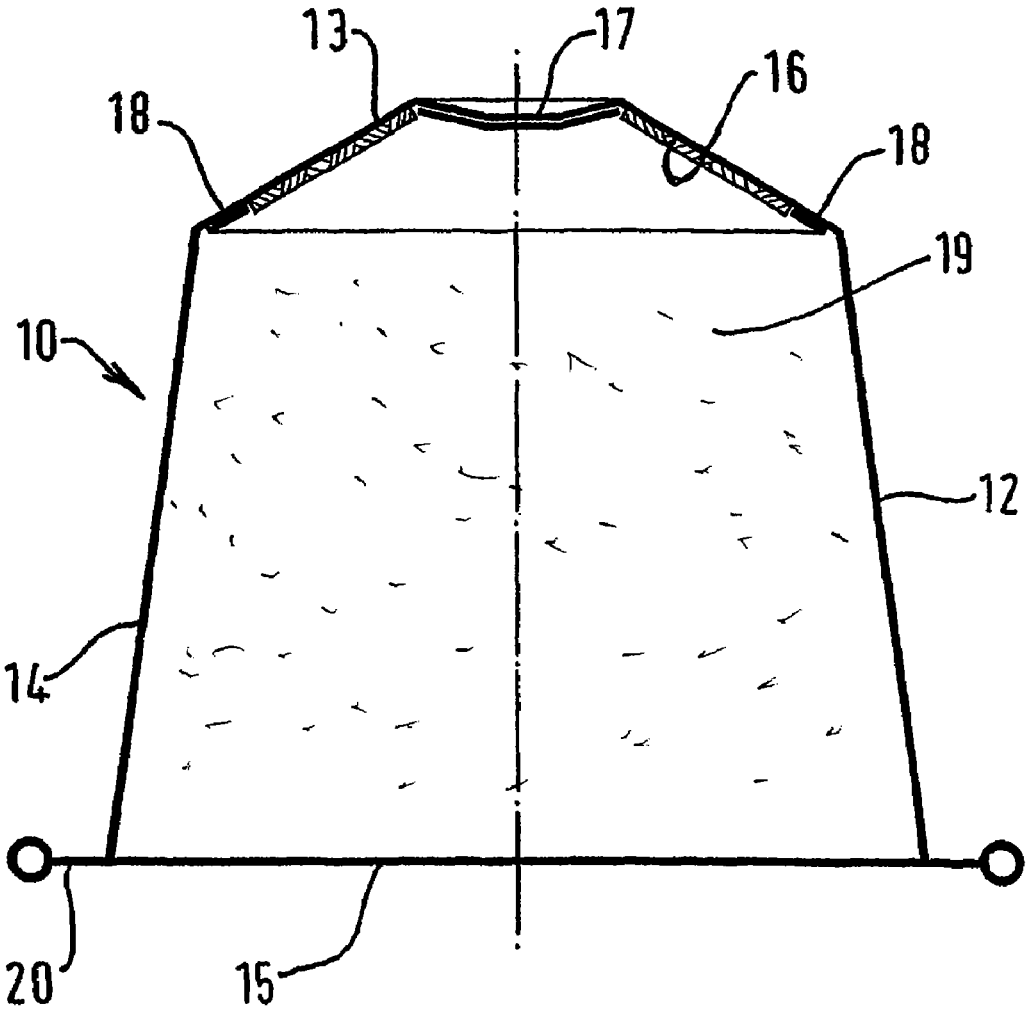
FIG. 1 is a cross-sectional diagrammatic representation of the cartridge according to the invention.

The solution of the invention, according to FIG. 1, is to provide, in the cartridge (10) with a container portion having a dish (12) with bottom (13) and side wall (14), with a circular edge (20) and a cover (15), a layer of fabric (16) made from polyurethane having a thickness of about 60 microns in the bottom (13). This layer is sealed over two zones of the bottom of the dish, namely in the central part (17) and in the peripheral part (18) of the said bottom. Sealing is effected over the entire periphery of the bottom. The bed of coffee (19) is deposited on the fabric (16). The cartridge shown contains 5 g of coffee and it has a diameter of 35 mm and a coffee-bed thickness of 30 mm. Sealing of the central part is effected over a diameter of the order of 8 mm and that of the peripheral part over a width of the order of 1-2 mm.

Figure 2:
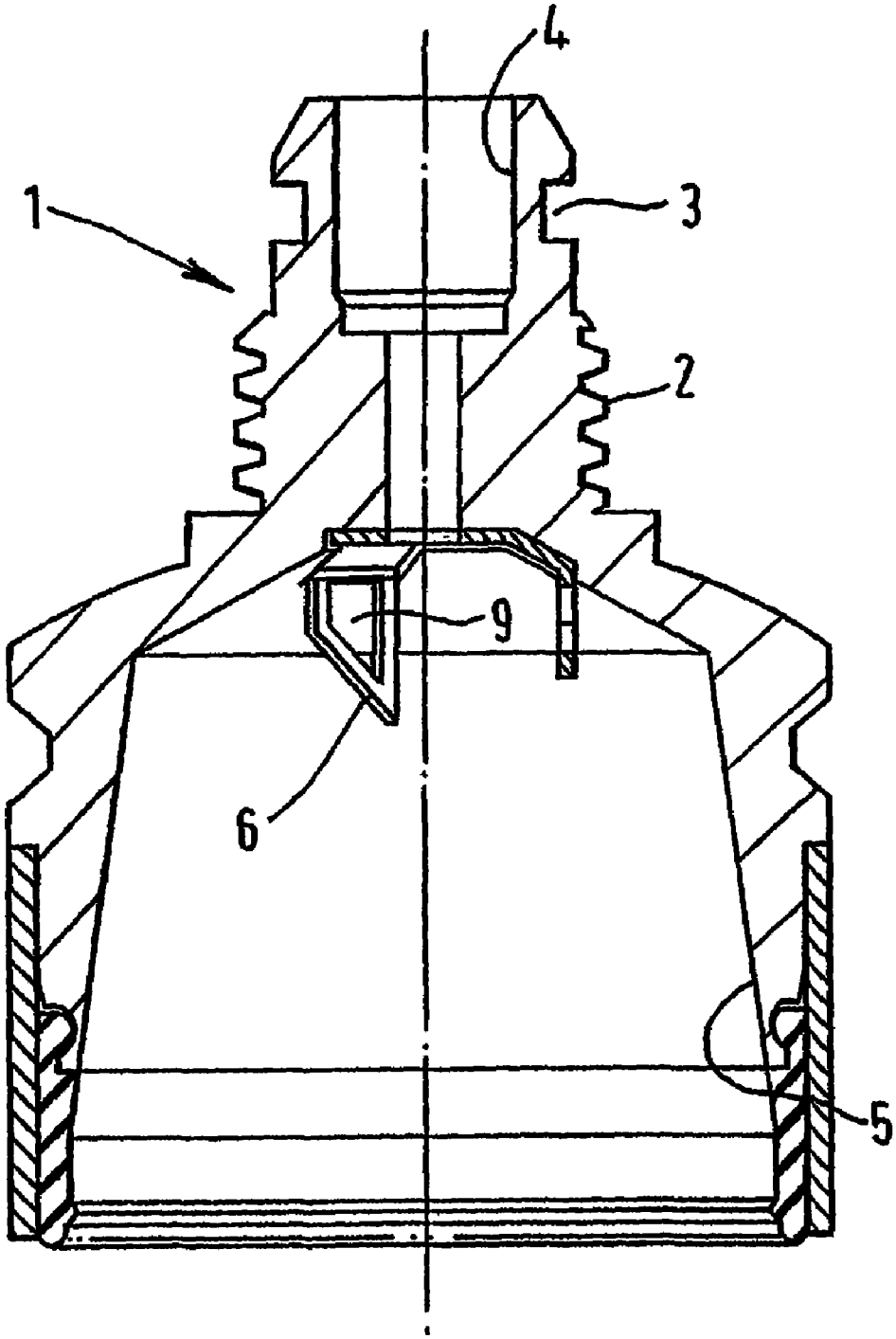
FIG. 2 is a partial section of the capsule cage for the extraction of the cartridge of FIG. 1.

The capsule cage (1) according to FIG. 2 comprises a thread (2) so that it can be screwed onto the coffee machine. The housing (3) is required so that a gasket can be arranged on it, allowing satisfactory sealing of the system. The channel (4) allows the supply of water into the housing (5) of the capsule. Directly at the exit from the channel (4) is the perforation system (6) consisting of three points with apertures (9).

When it is desired to extract the cartridge of FIG. 1, it is placed in the housing (5) of the capsule cage (1). The points (6) will puncture the bottom of the dish and perforate or push back the fabric (16) between the two sealing zones (17) and (18). The advantage of this fabric (16) is that it is resistant to perforation and the water passes through the fabric and, even if the fabric (16) is perforated anyway, at the end of extraction its flexibility and its elasticity enables it to re-close when the points (6) are removed from the cartridge, and the grounds do not emerge via the punctures. A cartridge guaranteeing satisfactory cleanliness of the extraction system is thus provided.

What is claimed is:

1. A sealed cartridge for preparing a food, comprising:

a container portion closed to define an interior space that contains a food product comprising a solid substance; and a retention member formed by a fabric which is comprised of a solid attached to the container portion along a central part and a peripheral part of a bottom of the container portion, wherein the peripheral part extends around the central part;

and a puncture member of a capsule cage located between the central and peripheral parts for opening said container portion, the fabric is attached to the bottom of the container portion for retaining the solid substance within the interior space when the puncture member is removed from the container portion.

2. The cartridge of claim 1, further comprising a cover sealed to a top of the container portion to further define the interior space between the top and bottom of the container portion.

3. The cartridge of claim 2, wherein the cover is configured for tearing under pressure by an extraction fluid in a capsule cage.

4. The cartridge of claim 1, wherein the container portion comprises:

a bottom wall;

side walls extending from the bottom wall; and the cover sealed to the side walls, the food product being contained within the bottom and side walls and the cover.

5. The cartridge of claim 4, wherein the central part extends along the bottom wall.

6. The cartridge of claim 5, wherein the peripheral part extends along the bottom wall.

7. The cartridge of claim 1, wherein the central part is substantially centered within the peripheral part.

8. The cartridge of claim 1, wherein:

the puncture member comprises a plurality of puncture members; and the central and peripheral parts are disposed for opening the container portion with the plurality of puncture members at a plurality of locations between the central and peripheral parts at which the retention member is attached to the container portion.

9. The cartridge of claim 8, wherein the plurality of locations are substantially concentric about the central part.

10. The cartridge of claim 1, wherein the solids retention member is attached to the interior of the container by sealing.

11. The cartridge of claim 1, wherein the fabric comprises a woven fabric.

12. The cartridge of claim 1, wherein the fabric comprises a non-woven fabric.

13. The cartridge of claim 1, wherein the retention member is elastic for reclosing after being perforated by the puncture member.

14. The cartridge of claim 1, wherein the retention member is configured for resisting perforation by the puncture member.

15. The cartridge of claim 1, wherein the food product comprises a food substance for preparing a beverage upon extraction from the cartridge.

16. The cartridge of claim 15, wherein the food product is ground roasted coffee, tea, instant coffee, a mixture of ground coffee and of instant coffee, a chocolate based product, a dehydrated edible substance, or a mixture thereof.

17. The cartridge of claim 1, wherein the retention member is attached within the interior space of the container portion.

* * * * *